US011745299B2

(12) United States Patent
Yamamoto et al.

(10) Patent No.: US 11,745,299 B2
(45) Date of Patent: Sep. 5, 2023

(54) GRINDING METHOD OF COMPOSITE SUBSTRATE INCLUDING RESIN AND GRINDING APPARATUS THEREOF

(71) Applicant: OKAMOTO MACHINE TOOL WORKS, LTD., Annaka (JP)

(72) Inventors: Eiichi Yamamoto, Annaka (JP); Takahiko Mitsui, Annaka (JP); Tsubasa Bando, Annaka (JP); Satoru Ide, Annaka (JP)

(73) Assignee: OKAMOTO MACHINE TOOL WORKS, LTD., Gunma (JP)

( * ) Notice: Subject to any disclaimer, the term of this patent is extended or adjusted under 35 U.S.C. 154(b) by 775 days.

(21) Appl. No.: 16/708,528

(22) Filed: Dec. 10, 2019

(65) Prior Publication Data

US 2020/0198083 A1 Jun. 25, 2020

(30) Foreign Application Priority Data

Dec. 20, 2018 (JP) ..... 2018-238095

(51) Int. Cl.
*B24B 7/22* (2006.01)
*B24B 55/02* (2006.01)

(52) U.S. Cl.
CPC ..... *B24B 7/228* (2013.01); *B24B 55/02* (2013.01)

(58) Field of Classification Search
CPC ..... B24B 7/228; B24B 13/005; B24B 37/04; B24B 37/044; B24B 37/10; B24B 37/12;
(Continued)

(56) References Cited

U.S. PATENT DOCUMENTS 9,368,474 B2 6/2016 Matsubara et al.
10,112,285 B2 10/2018 Fujiya et al.
(Continued)

FOREIGN PATENT DOCUMENTS

CN 1664993 A 9/2005
CN 104227547 A 12/2014
(Continued)

OTHER PUBLICATIONS

JP-2018049973-A translation (Year: 2018).*
JP-2007157930-A translation (Year: 2007).*
WO-2005092564-A1 translation (Year: 2005).*

*Primary Examiner* — Monica S Carter
*Assistant Examiner* — Abbie E Quann
(74) *Attorney, Agent, or Firm* — Rankin, Hill & Clark LLP

(57) ABSTRACT

A grinding apparatus and a grinding method of a composite substrate including resin, by which loading of a grinding wheel can be suppressed in grinding of a large-sized composite substrate including resin, and with which grinding can be effectively performed with high precision. This method for grinding a front surface of a composite substrate formed with a resin substrate embedded with at least one of a semiconductor device chip and an electrode, includes: bringing at least a part of a grinding member for grinding the front surface of the composite substrate into contact with the front surface; supplying water to at least one of a contacting part or a non-contacting part between the front surface of the composite substrate and the grinding member; and grinding the front surface of the composite substrate simultaneously with the supplying water.

6 Claims, 4 Drawing Sheets

(58) Field of Classification Search
CPC ..... B24B 37/30; B24B 37/345; B24B 37/042; B24B 37/07; B24B 37/107; B24B 41/061; B24B 55/02; B24B 53/007; B24B 55/03; B34C 3/085; B34C 3/086; B34C 3/12; B34C 3/20; B34C 3/22; B25B 11/005; H01L 21/6838
USPC ..... 451/38, 41, 82, 287, 288, 289, 388
See application file for complete search history.

(56) References Cited

U.S. PATENT DOCUMENTS

| | | | | |
|---|---|---|---|---|
| 10,964,576 | B2 | 3/2021 | Yamamoto et al. | |
| 11,040,427 | B2 | 6/2021 | Takenouchi | |
| 2015/0261211 | A1 | 9/2015 | Takenouchi | |
| 2016/0079204 | A1 | 3/2016 | Matsubara et al. | |
| 2017/0080547 | A1 | 3/2017 | Fujiya et al. | |
| 2017/0207108 | A1 | 7/2017 | Choi et al. | |
| 2018/0315635 | A1* | 11/2018 | Yamamoto | B24B 41/06 |

FOREIGN PATENT DOCUMENTS

| | | | | | |
|---|---|---|---|---|---|
| CN | 106985003 | A | | 7/2017 | |
| JP | 079342 | A | | 1/1995 | |
| JP | 2007157930 | A | * | 6/2007 | H01L 21/67051 |
| JP | 2007157930 | A | | 6/2007 | |
| JP | 2010051947 | A | | 3/2010 | |
| JP | 2014-028425 | A | | 2/2014 | |
| JP | 2015-032679 | A | | 2/2015 | |
| JP | 2015090945 | A | | 5/2015 | |
| JP | 2015-139829 | A | | 8/2015 | |
| JP | 2016058655 | A | | 4/2016 | |
| JP | 2017-112226 | A | | 6/2017 | |
| JP | 2017154186 | A | | 9/2017 | |
| JP | 2018049973 | A | * | 3/2018 | B24B 21/002 |
| JP | 2018049973 | A | | 3/2018 | |
| JP | 2018186217 | A | | 11/2018 | |
| TW | 201544235 | A | | 12/2015 | |
| TW | 201842596 | A | | 12/2018 | |
| WO | WO-2005092564 | A1 | * | 10/2005 | B24B 37/30 |

* cited by examiner

GRINDING METHOD OF COMPOSITE SUBSTRATE INCLUDING RESIN AND GRINDING APPARATUS THEREOF

CROSS-REFERENCE TO RELATED APPLICATION

This application claims priority from Japanese Patent Application No. 2018-238095 filed with the Japan Patent Office on Dec. 20, 2018, the entire content of which is hereby incorporated by reference.

BACKGROUND

1. Technical Field

The present disclosure relates to a method of grinding a composite substrate including resin and a grinding apparatus by using a packaging technique for producing a large quantity of semiconductor device chips or the like at the same time.

2. Related Art

A fan out panel level package (FOPLP) technique using a composite substrate including resin has been developed for production of a large quantity of semiconductor device chips and the like at low cost.

The FOPLP technology includes a variety of techniques. A main process of the FOPLP includes, firstly, dividing a completed semiconductor device wafer into semiconductor device chips. Then, the divided semiconductor device chips are arranged on a large-sized resin substrate. Next, a mold resin is formed on the resin substrate having the semiconductor device chips arranged thereon. With this configuration, the semiconductor device chips are embedded in the mold resin. Then, unnecessary mold resin is removed, so that the semiconductor device chips are exposed. Next, rewiring or the like is performed. After the rewiring, the semiconductor device chips are divided at a mold resin part. As a result, a semiconductor device chip packaged in the mold resin is completed.

Packaging technique of a semiconductor device chip includes a fan-in technique, in addition to the above-described fan-out technique. The fan-in technique forms all of the electrodes in a semiconductor device chip. Thus, the number of the electrodes is limited.

On the other hand, the fan-out technique can form an electrode in a resin part that is formed outside the semiconductor device chip. Thus, the fan-out technique has an advantage that the number of the electrodes is significantly increased compared with the fan-in technique. For this reason, techniques such as a microprocessor unit (MPU) or a logic device is becoming a major packaging technology for packaging a device having a large number of components for I/O.

In the FOPLP technology, a mold resin processing is required. In addition. Si electrode or Cu electrode may sometimes also be processed in the process of the packaging process. For such processing in the FOPLP, a fly cutter technique by using a diamond bite (for example, JP-A-2015-139829, and JP-A-2017-112226). The fly cutter technique is expensive in cost for processing. In addition, this technique requires a long time to obtain a higher degree of flatness. Furthermore, there is a problem that it is difficult to manage the thickness of a substrate.

As described in JP-A-2014-28425 and JP-A-2015-32679, a grinding technology that solves all the fly-cutter-related problem has been developed. Furthermore, this technology has been applied to wafer level package grinding and through silicon via (TSV).

SUMMARY

A method for grinding a front surface of a composite substrate formed with a resin substrate embedded with at least one of a semiconductor device chip and an electrode, including: bringing at least a part of a grinding member for grinding the front surface of the composite substrate into contact with the front surface; supplying water to at least one of a contacting part or a non-contacting part between the front surface of the composite substrate and the grinding member; and grinding the front surface of the composite substrate simultaneously with the supplying water.

BRIEF DESCRIPTION OF THE DRAWINGS

FIG. 5A illustrates a composite substrate including resin to be used;

FIG. 5B illustrates this composite substrate being placed on a vacuum chuck;

FIG. 5C illustrates this composite substrate being grinded:

FIG. 5D illustrates the composite substrate after grinding;

FIG. 6A illustrates a composite substrate having a resin substrate embedded with a semiconductor device chip that has an electrode formed thereon, and an electrode formed in an outer periphery of the semiconductor device chip; and FIG. 6B is a diagram illustrating a composite substrate embedded only with a semiconductor device chip.

DETAILED DESCRIPTION

Figure 1:
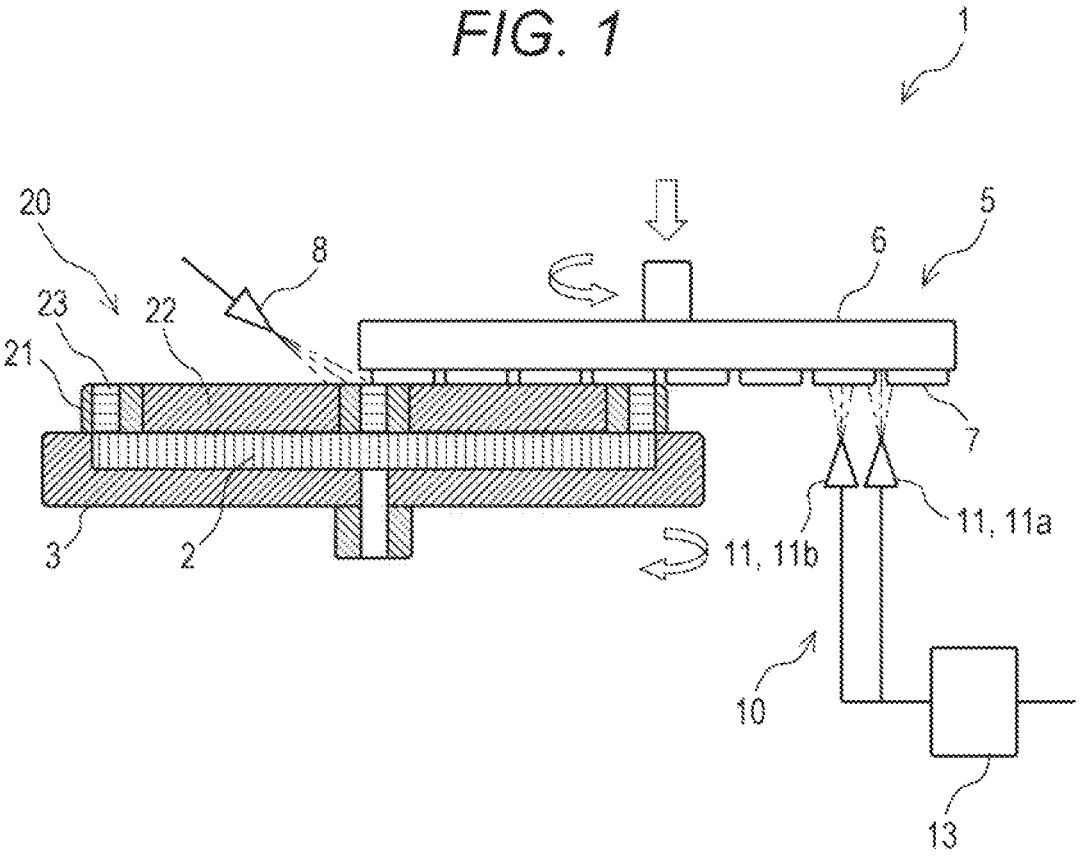
FIG. 1 is a diagram illustrating a schematic configuration of a grinding apparatus of a composite substrate including resin, according to an embodiment of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Upon grinding a FOPLP that is a large-sized substrate including resin, metal, and a semiconductor device chip, optimizing a grinding wheel is important. In order to maximize the sharpness of the grinding wheel, it is desirable to select an optimal diamond abrasive grain and an optimal bond material for the grinding wheel.

That is, an abrasive grain diameter (grit size) is important for the optimization of the grinding wheel because of the requirement for surface roughness. For grinding resin and metal, a bond material and a grade of hardness of the bond material are also important to minimize clogging.

For example, when a FOPLP substrate of 300 mm square or larger is processed with an optimized grinding wheel, clogging occurs even though a rough grinding wheel with a grit size of approximately #500 is used. Due to this clogging, there arises a problem that a plurality of substrates is not continuously processed. With rough grinding wheel, there arises a problem that a surface roughness of only approximately 100 nm (Ra) may be obtained by the grinding process. Furthermore, it is necessary that the polishing technology reduces the surface roughness with high precision in the following process. As a result, there arises a problem that a manufacturing cost increases.

The present disclosure is made in view of the above circumstances. An object of the present disclosure is to provide a method of grinding a composite substrate including resin and a grinding apparatus that can, during grinding a large-sized composite substrate including resin, suppress the clogging of a grinding wheel and effectively perform grinding process with high precision.

A method for grinding, according to the present disclosure, a front surface of a composite substrate formed with a resin substrate embedded with at least one of a semiconductor device chip and an electrode, including: bringing at least a part of a grinding member for grinding the front surface of the composite substrate into contact with the front surface; supplying water to at least one of a contacting part or a non-contacting part between the front surface of the composite substrate and the grinding member; and grinding the front surface of the composite substrate simultaneously with the supplying water.

The grinding apparatus of the composite substrate including resin of the present disclosure also includes a vacuum chuck mechanism for mounting and rotating a composite substrate formed with a resin substrate embedded with at least one of a semiconductor device chip and an electrode; a fixed abrasive wheel mechanism for grinding the composite substrate mounted on the vacuum chuck while rotating; a grinding water supply mechanism for supplying water to a contacting part between the composite substrate and the fixed abrasive wheel; and a high-pressure water supply mechanism for supplying high-pressure water from a high-pressure water supply nozzle to both of a contacting part and a non-contacting part between the fixed abrasive wheel and the composite substrate.

According to the grinding method of the composite substrate including resin of the present disclosure, includes bringing at least a part of a grinding member for grinding the front surface of the composite substrate into contact with the front surface; supplying water to at least one of a contacting part or a non-contacting part between the front surface of the composite substrate and the grinding member; and grinding the front surface of the composite substrate simultaneously with the supplying water. Thus, in the method of the present disclosure, high-pressure water is jetted from a plurality of high-pressure water supply nozzles against the portion where the fixed abrasive wheel and the composite substrate are not in contact with each other. This configuration can suppress the clogging of the fixed abrasive wheel. Therefore, the composite substrate can continuously be subjected to grinding. Thus, a fine grinding wheel of #2000 or larger, for example, can be continuously applied. As a result, a surface roughness of 10 nm (Ra) or less can be obtained, and a polishing process that is ought to be performed after the grinding process can be omitted. Therefore, a significant const reduction of product processing by FOPLP technology can be achieved.

In addition, clogging can also be suppressed even when a bond material of the fixed abrasive wheel is greatly hardened. Thus, this has an effect of significantly improving a life (product lifespan) of the fixed abrasive wheel. Therefore, cost reduction that is one of a primary purposes of the FOPLP technology can be achieved. A grinding apparatus of a composite substrate of the present disclosure, includes: a vacuum chuck mechanism for mounting and rotating a composite substrate formed with a resin substrate embedded with at least one of a semiconductor device chip and an electrode; a fixed abrasive wheel mechanism for grinding the composite substrate mounted on the vacuum chuck while rotating; a grinding water supply mechanism for supplying water to a contacting part between the composite substrate and the fixed abrasive wheel; and a high-pressure water supply mechanism for supplying high-pressure water from a high-pressure water supply nozzle to both of a contacting part and a non-contacting part between the fixed abrasive wheel and the composite substrate. With this configuration, upon grinding the large-sized FOPLP substrate, high-pressure water can be jetted against the fixed abrasive wheel from a plurality of high-pressure water supply nozzles while suppressing the clogging of the fixed abrasive wheel. Thus, the FOPLP substrate can continuously be grinded.

The grinding apparatus of the composite substrate including resin of the present disclosure, wherein the high-pressure water supply nozzle jets out high-pressure water under a pressure of from 3 to 20 MPa at a jet angle of from 5 to 20 degrees, and the fixed abrasive wheel and the high-pressure water supply nozzle are distanced from each other by from 5 to 30 mm. With this configuration, the high-pressure water supply nozzle can spray water having a flow rate and pressure suitable for cleaning the fixed abrasive wheel.

In addition, the grinding apparatus of the composite substrate including resin of the present disclosure, wherein the high-pressure water supply nozzle has a mechanism for swinging at a speed of from 1 to 20 mm/sec and a width of from 1 to 10 mm. With this configuration, high-pressure water can be jetted out in a wide range. Thus, the large-sized fixed abrasive wheel can be suppressed. Therefore, the large-sized FOPLP substrate can be grinded with high efficiency.

The grinding apparatus of the composite substrate including resin of the present disclosure, wherein the vacuum chuck has a suction area for mounting the composite substrate with a surface area of from 1000 to 7000 $cm^2$, and sucks the composite substrate with a thickness of from 0.1 to 2 mm in a flat state for grinding. With this configuration, a large-sized FOPLP substrate can efficiently be grinded with high pressure. As a result, excellent productivity is realized in product manufacturing with the FOPLP technology.

Hereinafter, a grinding method and a grinding apparatus of a composite substrate including resin according to an embodiment of the present disclosure will be described in detail with reference to the drawings.

FIG. 1 is a cross-sectional view illustrating a schematic configuration of a grinding apparatus 1 for grinding a composite substrate 20 including resin according to an embodiment of the present disclosure. The grinding apparatus 1 is an apparatus for grinding the composite substrate 20 including resin such as a large-sized FOPLP or the like.

The grinding apparatus 1 includes a vacuum chuck 2 having the composite substrate 20 to be processed mounted thereon, a cup-shaped fixed abrasive wheel 5 for grinding the composite substrate 20, and a grinding water supply nozzle 8.

The vacuum chuck 2 is a porous chuck that sucks and holds the composite substrate 20. This vacuum chuck 2 is substantially planar in shape and attached on a grinding table 3. The grinding table 3 having the vacuum chuck 2 placed thereon rotates around a rotational axis with a driving apparatus (not illustrated). The composite substrate 20 is placed on the top surface of the vacuum chuck 2 in a grinding process. In addition, the composite substrate 20 rotates horizontally around the rotation axis along with the vacuum chuck 2 and the grinding table 3.

The fixed abrasive wheel 5 is a wheel of a cup wheel type that grinds, from the upper side, the composite substrate 20 rotating while being held by the vacuum chuck 2. The fixed abrasive wheel 5 includes a grinding head 6 and a grinding wheel 7. The grinding head 6 is substantially disk-shaped and horizontally rotates by a rotation mechanism (not illustrated). A grinding wheel 7 is attached near the lower side of the circumference of the grinding head 6 along circumference of the grinding head in a substantially circular shape.

Furthermore, the grinding apparatus 1 includes a vertical movement mechanism that moves the fixed abrasive wheel 5 in a vertical direction by using a ball screw (not illustrated). This cutting edge (not shown) contacts with the top surface of the composite substrate 20 that is sucked onto the top surface of the vacuum chuck 2 and rotates horizontally, the cutting edge being located to the lower portion of grinding wheel 7 of the fixed abrasive wheel 5 that rotates horizontally. The top surface of the composite substrate 20 is then grinded by the cutting edge.

The grinding water supply nozzle 8 is an apparatus for supplying water to a vicinity of a part where the composite substrate 20 and the grinding wheel 7 of the fixed abrasive wheel 5 comes in contact with each other. This water may be pure water. Specifically, a grinding water supply apparatus supply pure water through the grinding water supply nozzle 8. Then, pure water is jetted toward the vicinity of a part where the top surface of the composite substrate 20 and the cutting edge of the grinding wheel 7 come in contact with each other from a jet outlet of the grinding water supply nozzle 8.

The above-described configuration is suitable for grinding. However, it is extremely difficult to perform grinding on a large-sized composite substrate 20 including resin with high precision by solely using the above configuration. The grinding apparatus 1 according to the present embodiment includes a high-pressure water supply mechanism 10 that sprays high-pressure water on the fixed abrasive wheel 5 for cleaning, in addition to the above-described configuration.

The high-pressure water supply mechanism 10 is provided with a high-pressure water supply nozzle 11 and a high-pressure water pressure controller 13. The high-pressure water supply nozzle 11 jets out high-pressure water to a part where the fixed abrasive wheel 5 does not contact with the composite substrate 20. The high-pressure water pressure controller 13 adjusts a pressure and a flow rate of the high-pressure water to be jetted out to the fixed abrasive wheel 5 to a desired value. This adjusted high-pressure water is supplied to the high-pressure water supply nozzle 11 and jetted out toward the fixed abrasive wheel 5.

With the above configuration, a pressure and a flow rate of pure water is adjusted by the high-pressure water pressure controller 13 of the high-pressure water supply mechanism 10 and jetted toward a vicinity of the cutting edge of the grinding wheel 7 via the high-pressure water supply nozzle 11 in a grinding process.

The grinding apparatus 1 according to the present embodiment is provided with a plurality of high-pressure water supply nozzles 11 of the high-pressure water supply mechanism 10. Specifically, two high-pressure water supply nozzles 11 are provided, which are the first high-pressure water supply nozzle 11*a* and the second high-pressure water supply nozzle 11*b*, for example. The number of high-pressure water supply nozzles of the high-pressure water supply mechanism 10 may not only be limited to two but also three or more.

With such a configuration of including a plurality of high-pressure water supply nozzles 11, upon grinding the composite substrate 20 that is a large-sized FOPLP substrate, high-pressure water can be jetted from the plurality of high-pressure water supply nozzles 11 to the fixed abrasive wheel 5 in order to suppress the clogging of the fixed abrasive wheel 5. Accordingly, the FOPLP substrate can be continuously grinded.

Figure 2:
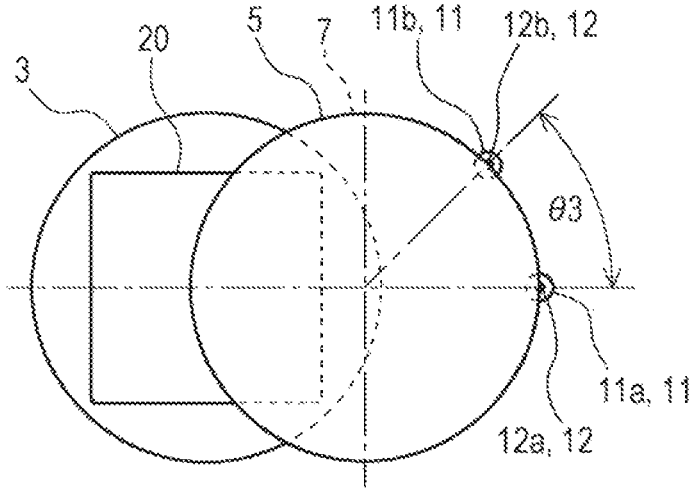
FIG. 2 is a plan view illustrating a schematic configuration of a grinding apparatus of a composite substrate including resin according to an embodiment of the present disclosure, and a diagram illustrating one example position of a high-pressure water supply nozzle for supplying high-pressure water.

FIG. 2 is a plan view illustrating a schematic configuration of the grinding apparatus 1. Specifically, FIG. 2 is a diagram illustrating one example position of the plurality of high-pressure water supply nozzles 11. As illustrated in FIG. 2, the first high-pressure water supply nozzle 11*a* and the second high-pressure water supply nozzle 11*b* may be positioned at different positions within a rotational circumferential direction of the fixed abrasive wheel 5 when using a rotation center of the fixed abrasive wheel 5 as a reference.

Specifically, as illustrated in FIG. 2, a high-pressure water jet outlet 12*a* of the first high-pressure water supply nozzle 11*a*, and a high-pressure water jet outlet 12*b* of the second high-pressure water supply nozzle 11*b* are away from each other by an angle θ3 within the rotational circumferential direction when using the rotation center of the fixed abrasive wheel 5 as a reference. With such a configuration, as illustrated in FIG. 1, high-pressure water may be jetted out in a wide range to the plurality of grinding wheels 7 of the fixed abrasive wheel 5. As a result, high-pressure water suitable for suppressing the clogging of the fixed abrasive wheel 5 may be jetted out.

Figure 3:
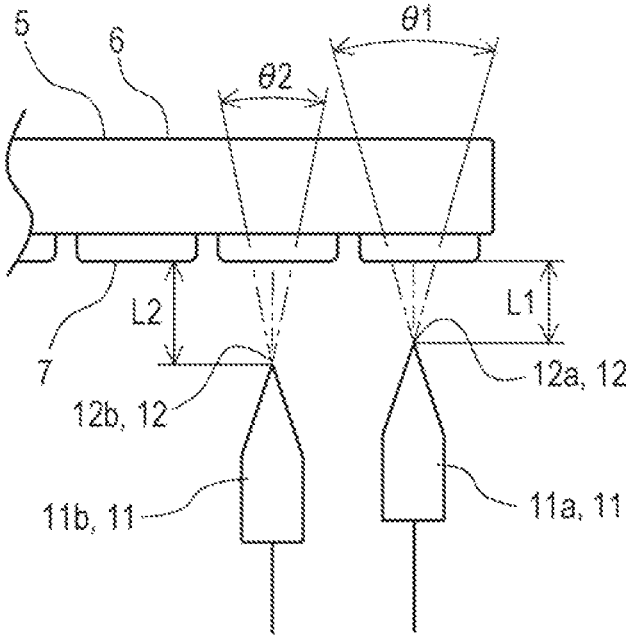
FIG. 3 is a diagram illustrating a vicinity of a high-pressure water supply nozzle of a grinding apparatus of a composite substrate including resin according to an embodiment of the present disclosure, and a position of a high-pressure water jet outlet for jetting out high-pressure water.

FIG. 3 is a diagram illustrating a vicinity of a high-pressure water jet outlet 12 of the high-pressure water supply nozzle 11 of the grinding apparatus 1 according to the present embodiment. FIG. 3 also schematically illustrates a position of the high-pressure water jet outlet 12 in a vertical direction. As illustrated in FIG. 3, the high-pressure water supply nozzle 11 is disposed so that distances L1 and L2 from the high-pressure water jet outlet 12 to the cutting edge of the grinding wheel 7 of the fixed abrasive wheel 5 is from 5 to 30 mm, and more preferably, from 15 to 25 mm. With this configuration, high-pressure water to be jetted out from the high-pressure water supply nozzle 11 may be suitable for cleaning the fixed abrasive wheel 5.

One of the first high-pressure water supply nozzle 11*a* or the second high-pressure water supply nozzle 11*b* may be positioned closer to the fixed abrasive wheel 5. For example, as illustrated in FIG. 3, the first high-pressure water supply nozzle 11*a* may be positioned closer to the fixed abrasive wheel 5 than the second high-pressure water supply nozzle 11*b*. In this case, the first high-pressure water supply nozzle 11*a* is positioned higher than the second high-pressure water supply nozzle 11*b* in a vertical direction. In other words, the distances L1 and L2 may be different from each other when the distance L1 is a distance from the high-pressure water jet outlet 12*a* of the first high-pressure water supply nozzle 11*a* to the grinding wheel 7, and the distance L2 is a distance from the high-pressure water jet outlet 12*b* of the second high-pressure water supply nozzle 11*b* to the grinding wheel 7.

High-pressure water jetted out from the high-pressure water supply nozzle 11 is preferably from 3 to 20 Mpa, and more preferably from 10 to 14 MPa. Jet angles θ1 and θ2 at which the high-pressure water is jetted out from the high-pressure water supply nozzle 11 are preferably from 5 to 20 degrees, and more preferably from 8 to 12 degrees.

The jet angles θ1 and θ2 may be different from each other when the jet angle θ1 is a jet angle of high-pressure water jetted out from the high-pressure water jet outlet 12*a* of the first high-pressure water supply nozzle 11*a*, and the jet angle θ2 is a jet angle of high-pressure water jetted out from the high-pressure water jet outlet 12*b* of the second high-pressure water supply nozzle 11*b*. For example, as illustrated in FIG. 3, the jet angle θ1 may be set to be greater than the jet angle θ2 when the jet angle θ1 is the jet angle of the high-pressure water from the high-pressure water jet outlet 12*a* of the first high-pressure water supply nozzle 11*a*, and the jet angle θ2 is the jet angle of the high-pressure water from the high-pressure water jet outlet 12*b* of the second high-pressure water supply nozzle 11*b*.

Figure 4:
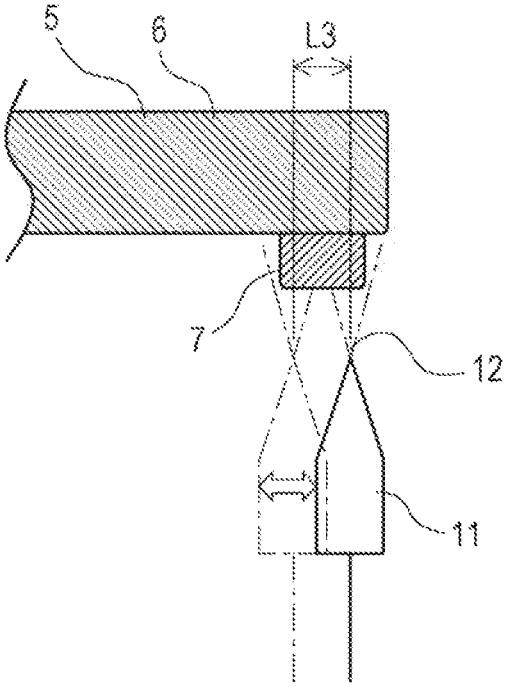
FIG. 4 is a diagram illustrating a vicinity of a high-pressure water supply nozzle of a grinding apparatus of a composite substrate including resin according to an embodiment of the present disclosure, and a cross-sectional view schematically illustrating the high-pressure water supply nozzle that swings.

FIG. 4 is a cross-sectional view illustrating a vicinity of the high-pressure water jet outlet 12 of the high-pressure water supply nozzle 11 of the grinding apparatus 1. This diagram schematically illustrates the high-pressure water supply nozzle 11 that swings. As illustrated in FIG. 4, the high-pressure water supply nozzle 11 may have a mechanism for swinging at a speed of from 1 to 20 mm/sec and a swing width L3 of from 1 to 10 mm. This may permit high-pressure water to be jetted out in a wide range, resulting in clogging of the large-sized fixed abrasive wheel 5. The composite substrate 20 of the large FOPLP substrate or the like can thereby be efficiently grinded.

The high-pressure water supply nozzle 11 may be, although not illustrated in the drawings, disposed such that a central axis of the high-pressure water supply nozzle 11 is inclined with respect to the rotation axis of a fixed abrasive wheel 5. That is, a jet direction of the high-pressure water to be jetted out from the jet outlet of the nozzle may be inclined. The high-pressure water supply nozzle 11 may be rotatably provided such that the central axis of this high-pressure water supply nozzle 11 is inclined in such way.

FIG. 5 is a diagram illustrating a grinding process of the composite substrate 20. FIG. 5A illustrates a composite substrate 20 including resin to be used. FIG. 5B illustrates this composite substrate 20 being placed on a vacuum chuck. FIG. 5C illustrates this composite substrate 20 being grinded. FIG. 5D illustrates a thinned composite substrate 20 after grinding.

Figure 5A:
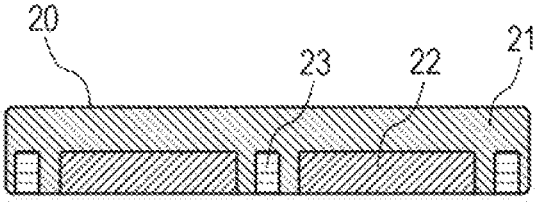
FIGS. 5A to 5D are diagrams illustrating a grinding process of a composite substrate including resin according to an embodiment of the present disclosure.

As illustrated in FIG. 5A, the composite substrate 20 is a FOPLP substrate, for example. A semiconductor device chip 22 and an electrode 23 are embedded in a resin substrate 21. Specifically, the semiconductor device chip 22 is embedded in the resin substrate 21 of this composite substrate 20. In addition, the electrode 23 is formed in an outer periphery of this semiconductor device chip 22. The composite substrate 20 is a large-sized mounting substrate with a surface area of from 1000 to 7000 $cm^2$ and a thickness of from 0.1 to 2 mm.

The resin substrate 21 is made of epoxy resin, for example. The semiconductor device chip 22 is made of silicon (Si), for example. The electrode 23 is made of metal including copper (Cu) and aluminum (Al), for example. The resin substrate 21 may also be made of encapsulation material of different types such as urethane resin, silicon resin, or polyimide resin. The grinding apparatus 1 according to the present embodiment can obtain an excellent grinding result even when a composite substrate in which a variety of kinds of resin having a silica filler for improving an electrical characteristics is employed as the resin substrate 21.

Figure 5B:
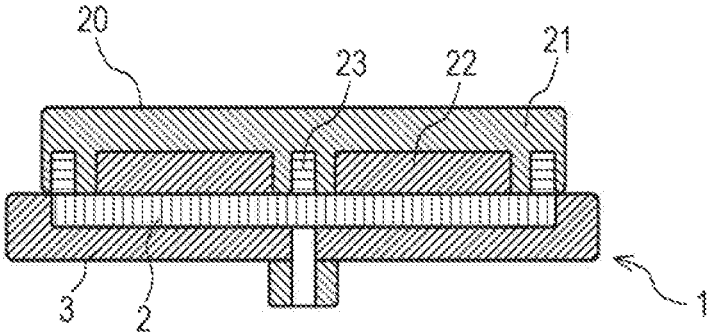

As illustrated in FIG. 5B, the large-sized composite substrate 20 is mounted on the vacuum chuck 2, the large-sized composite substrate 20 including a resin of the resin substrate 21 and having the semiconductor device chip 22 embedded therein. Specifically, the composite substrate 20 is sucked and held on the top surface of the vacuum chuck 2 with the composite substrate 20 having the to-be-grinded top surface as a surface with the resin substrate 21, and a bottom surface as a surface embedded with the semiconductor device chip 22 and the like.

Figure 5C:
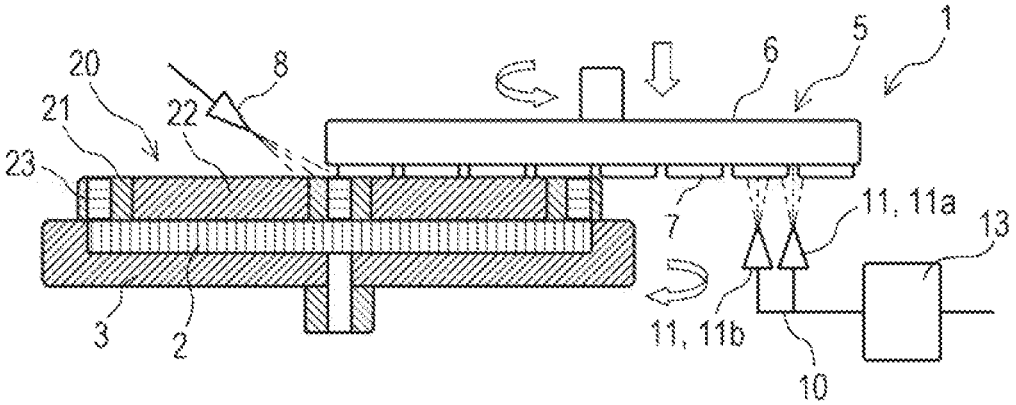

As illustrated in FIG. 5C, the fixed abrasive wheel 5 is lowered while rotating horizontally in a grinding process that uses an in-feed grinding method. The fixed abrasive wheel 5 contacts with the top surface of the composite substrate 20 that rotates horizontally while being held by the vacuum chuck 2 as mentioned above. Therefore, the composite substrate 20 is grinded and thinned.

In other words, the grinding table 3 rotates horizontally in this grinding process. Also, the grinding head 6 of the fixed abrasive wheel 5 including the grinding wheel 7, rotates while being lowered. The grinding wheel 7 is jetted with high pressure pure water jetted from the grinding water supply nozzle 8. In other words, this pure water is jetted to a part where the grinding wheel 7 contacts with a front surface of the substrate 20 to be grinded. High pressure pure water is jetted from two high-pressure water supply nozzles 11*a* and 11*b* to the grinding wheel 7. In other words, pure water is also jetted to a part where the grinding wheel 7 does not contacts with the front surface of the substrate 20 to be grinded. High-pressure water may be jetted to only one of the contacting part and the non-contacting part in order to suppress clogging of the grinding wheel. Needless to say, high-pressure water may be jetted to both of the contacting part and the non-contacting part.

In a grinding process, firstly, only the resin substrate 21 on an upper part of the composite substrate 20 is grinded. Next, as the composite substrate 20 is grinded down, the resin substrate 21, the semiconductor device chip 22, and the electrode 23 are grinded at the same time.

A condition for grinding is suitably adjusted depending on a state of a surface of the composite substrate 20 to be grinded so that an excellent flatness is obtained after the grinding. For example, as the grinding wheel 7 of the fixed abrasive wheel 5, a vitrified bond SD #4000 grinding wheel may be selected.

The fixed abrasive wheel 5 is preferably lowered at a speed of from 10 to 30 μm/min, with the optimal speed of 20 μm/min. A rotational speed of the fixed abrasive wheel 5 is preferably from 1000 to 2000) $min^{-1}$, with the optimal rotational speed of 1450 $min^{-1}$.

A rotational speed of the vacuum chuck 2 is preferably from 100 to 400 $min^{-1}$, with the optimal rotational speed of 197 $min^{-1}$. A jetting amount of pure water from the grinding water supply nozzle 8 is suitably 10 L/min, for example.

Pressure of high-pressure water to be jetted out from the high-pressure water supply nozzle 11 is suitably set depending on the composite substrate 20. This pressure is from 3 to 20 MPa as described above, with a preferable pressure from 10 to 14 MPa, for example, 12 MPa. The jet angles θ1 and θ2 (see FIG. 3) of high-pressure water to be jetted out from the high-pressure water supply nozzle 11 are preferably from 5 to 20 degrees, with more preferable jet angles of 8 degrees to 12 degrees.

Even when the two high-pressure water supply nozzles 11 jet out pure water under the same jetting pressure condition, a suitable grinding result can be obtained. The two high-pressure water supply nozzles 11 may also be set to jet out under jetting pressure condition different from each other, depending on a size of the composite substrate 20, an area ratio of the resin substrate 21 and the electrode 23, and the like.

For example, the first grinding water supply nozzle 11*a* may jet out pure water under high pressure and the second grinding water supply nozzle 11*b* may jet out pure water under low pressure. In other words, pressure of high-pressure water to be jetted out from the first grinding water supply nozzle 11*a* may be set to be higher than pressure of high-pressure water to be jetted out from the second grinding water supply nozzle 11*b*. Alternatively, the first grinding water supply nozzle 11*a* may be set to jet out high-pressure water under low pressure and the second grinding water supply nozzle 11*b* may be set to jet out high-pressure water under high pressure.

With reference to FIG. 3, as described above, the jet angle θ1 is the jet angle of the high-pressure water jetted out from the high-pressure water jet outlet 12*a* of the first high-pressure water supply nozzle 11*a*, and the jet angle θ2 is the jet angle of the high-pressure water jetted out from the high-pressure water jet outlet 12*b* of the second high-pressure water supply nozzle 11*b*. The jet angles θ1 and θ2 may be set to a suitable angle.

Therefore, jetting pressure of pure water jetted out by the high-pressure water supply nozzle 11 is changed depending on a state of a composite substrate 20 to be processed. This permits suitably controlling surface roughness and grinding speed of the composite substrate 20 to be processed.

Figure 5D:
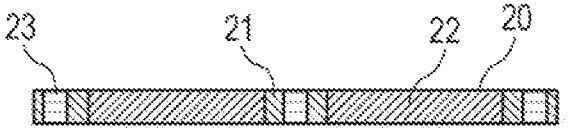

With reference to FIG. 5D, a composite substrate 20 that is thinned with high precision is obtained through the above grinding process. Specifically, after being grinded, this composite substrate 20 has the resin substrate 21 with a surface roughness of from 7 to 10 nm (Ra), the semiconductor device chip 22 with a surface roughness of from 3 to 5 nm (Ra), and the electrode 23 with a surface roughness of from 5 to 7 nm (Ra).

With this configuration, after being grinded by the grinding apparatus 1, the composite substrate 20 can obtain excellent surface roughness without the electrode 23 being pulled or discolored because of clogging of the fixed abrasive wheel 5.

Figure 6A:
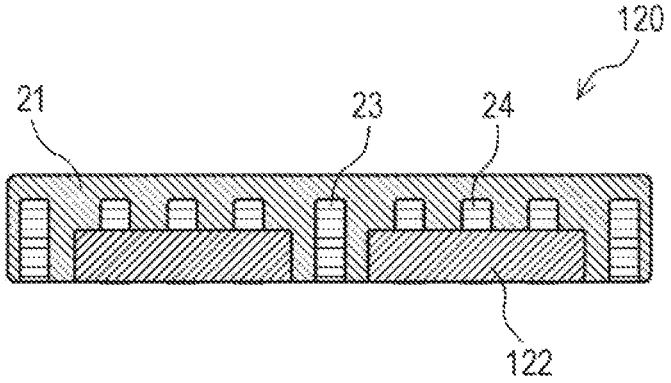
FIGS. 6A and 6B are diagrams illustrating another example of a composite substrate that is processed by a grinding apparatus of a composite substrate including resin according to an embodiment of the present disclosure.
Figure 6B:
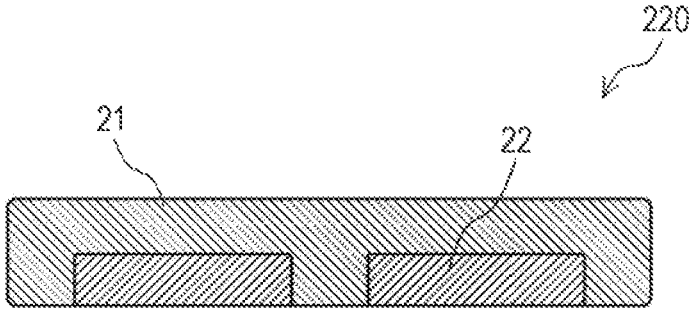

FIG. 6 is a diagram illustrating another example composite substrate 120 to be processed by the grinding apparatus 1 according to the present embodiment. FIG. 6A illustrates a resin substrate 21 embedded with a semiconductor device chip 122 having a front surface that has an electrode 24 formed thereon. In this composite substrate 120, an electrode 23 is formed in an outer periphery of the semiconductor device chip 122. FIG. 6B is a diagram illustrating a composite substrate 220 embedded only with a semiconductor device chip 22.

As illustrated in FIG. 6A, the composite substrate 120 has the resin substrate 21 embedded with the semiconductor device chip 122 having the front surface that has the electrode 24 formed thereon, and the electrode 23 formed in the outer periphery of the semiconductor device chip 122. Such composite substrate 120 may also be grinded by the grinding apparatus 1 according to the present embodiment.

As illustrated in FIG. 6B, the composite substrate 220 has a resin substrate 21 embedded only with the semiconductor device chip 22. Such composite substrate 220 may also be grinded by the grinding apparatus 1. The grinding apparatus 1 may also grind a composite substrate having a resin substrate 21 embedded only with an electrode 23, but this is not illustrated.

Thus, even when the resin substrates 21 of the composite substrates 20, 120, and 220 are embedded with at least one of a plurality of semiconductor device chips 22, and a plurality of semiconductor device chips 122 and a plurality of electrodes 23 and 24, the grinding apparatus 1 can grind such composite substrates 20, 120, and 220 with high precision and high efficiency.

As described above, the grinding apparatus 1 according to the present embodiment is configured with a plurality of high-pressure water supply nozzles 11 for jetting out high-pressure water. This high-pressure water is jetted out not only to the contacting part between the fixed abrasive wheel 5 and the surface of the composite substrate 20 to be grinded, but also to the non-contacting part between them. This permits suppressing the clogging of the fixed abrasive wheel 5. The composite substrate 20 can thereby be continuously grinded.

Specifically, grinding may be continuously performed by using a fine grinding wheel 7 with a grit size of #2000 or higher, for example. As a result, a surface roughness of 10 nm (Ra) or less may be achieved. Thus, such surface roughness permits omitting a polishing process to be performed after the grinding process. Therefore, a production cost can be significantly reduced in using a FOPLP technology.

The grinding apparatus according to the present embodiment may suppress clogging even when the bond material of the grinding wheel 7 of the fixed abrasive wheel 5 is greatly hardened. Thus, this is effective in significantly improving a life (product lifespan) of the fixed abrasive wheel 5. As a result, a primary purpose of the FOPLP technology, i.e., cost reduction, can be further promoted.

Using the grinding method or the grinding apparatus 1 according to the present embodiment for grinding the composite substrate 20 including the resin substrate 21, the semiconductor device chip 22, and the electrode 23 permits processing a FOPLP substrate for a three-dimensional semiconductor device employing high-speed quality in a compact and densified body. Along with that, a big challenge of realizing cost reduction is achieved, which greatly contributes to development of semiconductor device industry.

The present disclosure is not limited to the above embodiment. For example, the fixed abrasive wheel of the grinding apparatus of the present disclosure may be a grinding wheel of another type instead of the above-described fixed abrasive wheel 5 of a cup wheel type. In addition, the fixed abrasive wheel may be provided to rotate vertically, for example. Other various modifications may be employed within a scope not departing from the gist of the present disclosure. The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A grinding apparatus of a composite substrate, comprising:

a vacuum chuck mechanism for mounting and rotating the composite substrate formed with a resin substrate embedded with at least one of a semiconductor device chip and an electrode;

a fixed abrasive wheel mechanism for grinding the composite substrate mounted on the vacuum chuck while rotating;

a grinding water supply mechanism for supplying water to a contacting part between the composite substrate and the fixed abrasive wheel; and a high-pressure water supply mechanism for supplying high-pressure water from a high-pressure water supply nozzle to both of a contacting part and a non-contacting part between the fixed abrasive wheel and the composite substrate, wherein the high-pressure water supply nozzle has a mechanism for swinging at a speed of from 1 to 20 mm/sec and a width of from 1 to 10 mm.

2. The grinding apparatus of the composite substrate including resin according to claim 1, wherein the high-pressure water supply nozzle jets out high-pressure water under a pressure of from 3 to 20 MPa at a jet angle of from 5 to 20 degrees, and the fixed abrasive wheel and the high-pressure water supply nozzle are distanced from each other by from 5 to 30 mm.

3. The grinding apparatus of the composite substrate including resin according to claim 2, wherein the high-pressure water supply nozzle jets out high-pressure water under a pressure of from 10 to 14 MPa at a jet angle of from 8 to 12 degrees, and the fixed abrasive wheel and the high-pressure water supply nozzle are distanced from each other by from 15 to 25 mm.

4. The grinding apparatus of the composite substrate including resin according to claim 1, wherein the vacuum chuck has a suction area for mounting the composite substrate with a surface area of 1000 to 7000 $cm^2$, and sucks the composite substrate with a thickness of 0.1 to 2 mm in a flat state for grinding.

5. A method for grinding a front surface of the composite substrate formed with the resin substrate embedded with at least one of the semiconductor device chip and the electrode by the grinding apparatus of claim 1, comprising: bringing at least a part of the fixed abrasive wheel mechanism for grinding the front surface of the composite substrate into contact with the front surface; supplying the high-pressure water to at least one of the contacting part or the non-contacting part between the front surface of the composite substrate and the grinding member; and grinding the front surface of the composite substrate simultaneously with the supplying water.

6. The method of claim 5, wherein at least one of a flow rate and pressure of the high-pressure water is adjustable.

* * * * *